US007533653B2

(12) United States Patent
Hotta

(10) Patent No.: US 7,533,653 B2
(45) Date of Patent: May 19, 2009

(54) INTAKE AIR CONTROL SYSTEM FOR A V-TYPE INTERNAL COMBUSTION ENGINE AND ENGINE INCORPORATING SAME

(75) Inventor: Kazuhito Hotta, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/879,305

(22) Filed: Jul. 17, 2007

(65) Prior Publication Data

US 2008/0029055 A1 Feb. 7, 2008

(30) Foreign Application Priority Data

Aug. 4, 2006 (JP) ..... 2006-213297

(51) Int. Cl.
*F02D 9/10* (2006.01)
*F02D 9/08* (2006.01)

(52) U.S. Cl. ..... 123/336; 123/399

(58) Field of Classification Search ..... 123/399, 123/336, 337, 308, 432, 184.31; 251/305
See application file for complete search history.

(56) References Cited

U.S. PATENT DOCUMENTS

2004/0244768 A1 12/2004 Udono
2005/0133004 A1* 6/2005 Maehara et al. ..... 123/336
2006/0231069 A1 10/2006 Hanasato

FOREIGN PATENT DOCUMENTS

| | | |
|---|---|---|
| EP | 1464811 | 10/2004 |
| EP | 1548252 | 6/2005 |
| EP | 1555409 | 7/2005 |
| EP | 1630382 | 3/2006 |
| JP | 2002-256900 | 9/2002 |

* cited by examiner

*Primary Examiner*—Mahmoud Gimie
(74) *Attorney, Agent, or Firm*—Carier, Blackman & Associates, P.C.; William D. Blackman; Joseph P. Carrier

(57) ABSTRACT

An intake air control system of a V-type internal combustion engine is arranged in a V-shaped space defined between front and rear banks of the engine. The intake air control system includes front and rear throttle bodies having front and rear throttle valves thereon, and a plurality of electrically-operated actuators which drive the throttle valves. The electrically-operated actuators are arranged between the front and rear banks. The arrangement of the electrically-operated actuators prevents overheating thereof, and provides a storing space for disposing auxiliary equipment in a lower portion of the V-shaped space. The front bank includes an opening formed therein which directs wind towards the electrically-operated actuators disposed in the V-shaped space during operation of the vehicle.

20 Claims, 5 Drawing Sheets

INTAKE AIR CONTROL SYSTEM FOR A V-TYPE INTERNAL COMBUSTION ENGINE AND ENGINE INCORPORATING SAME

CROSS-REFERENCE TO RELATED APPLICATIONS

The present application claims priority under 35 USC § 119 based on Japanese patent application No. 2006-213297, filed on Aug. 4, 2006. The entire subject matter of this priority document is herein incorporated by reference.

BACKGROUND OF THE INVENTION

1. Field of the Invention

The present invention relates to an intake air control system for a V-type internal combustion engine. More particularly, the present invention relates to an intake air control system for a V-type engine in which electrically-operated throttle actuators are situated at an upper portion of a space defined between banks of the V-type engine.

2. Description of the Background Art

Conventionally, in an intake air control system of a V-type internal combustion engine, a throttle valve, for controlling a flow rate of intake air in an intake passage, is provided within a throttle body. Such throttle valve is driven by an electrically-operated actuator based on a throttle manipulation quantity. The electrically-operated actuator is arranged in a V-shaped space defined between two banks of the V-type internal combustion engine. An example of such configuration of the electrically-operated actuator(s) is disclosed in the Japanese patent document number JP-A-2002-256900.

According to the Japanese patent document JP-A-2002-256900, the V-shaped space, which is formed between two banks of the V-type engine, is a space in which various kinds of auxiliary equipments or the like of the internal combustion engine are arranged.

Accordingly, in an attempt to arrange the electrically-operated actuator for driving the throttle valve in the V-shaped space, it is necessary to take measures which will not impose restriction on the arrangement of the auxiliary equipments.

Further, since the V-shaped space is formed between two banks of the V-type engine, which are heated due to combustion activity in the cylinders, the V-shaped space is liable to be easily filled with hot air. Therefore, it is necessary to take measures to prevent the electrically-operated actuator, especially, a drive motor thereof from being excessively thermally influenced by the hot air from the engine for enhancing the durability thereof. However, the intake system structure described in the patent document JP-A-2002-256900 fails to take the above-mentioned measures into consideration.

Accordingly, the present invention has been made under such circumstances. It is an object of the present invention to provide an intake air control system for a V-type internal combustion engine which ensures a space for arranging existing auxiliary equipments or the like in a V-shaped space, and facilitates cooling of an electrically-operated actuator situated in the V-shaped space, thereby enhancing the durability of the electrically-operated actuator.

SUMMARY OF THE INVENTION

To achieve the above-mentioned objects, the present invention is directed to an intake air control system of a V-type internal combustion engine.

According to the first aspect of the present invention the intake air control system is provided for a V-type of engine having front and rear banks and cylinder axes of the cylinders formed on the respective banks exhibiting a V-shape cross section when viewed in an axial direction of the crankshaft. The intake air control system includes front and rear intake ports which are formed in the respective front and rear banks. The intake system also includes front and rear throttle bodies having front and rear throttle valves mounted thereon and electrically-operated actuators for driving the throttle valves. The electrically-operated actuators are respectively arranged between cylinder heads of the front and rear banks and the front and rear throttle bodies. In other words, the electrically-operated actuators are arranged in an upper portion of the V-shaped space between the front and rear banks.

Further, to achieve the above-mentioned objects, the present invention according to the second aspect, in addition to the first aspect, is characterized in that the V-type internal combustion engine is a 4-cylinder engine having two cylinders on each the front and rear banks. In a configured state, i.e., when the V-type internal combustion engine is mounted on a vehicle, a crankshaft of the V-type internal combustion engine is arranged in orthogonal direction to an advancing (front) direction of the vehicle, and a plurality of electrically-operated actuators are mounted on the front bank which is positioned towards a front side in the advancing direction of the vehicle.

Furthermore, to achieve the above-mentioned objects, the present invention, according to the third aspect, in addition to the first aspect, is characterized in that the V-type internal combustion engine is a 4-cylinder engine having two cylinders on mounted on each of the front and rear banks. In a configured state, i.e., when the V-type internal combustion engine is mounted on a vehicle, a crankshaft of the V-type internal combustion engine is arranged orthogonal to the advancing direction of the vehicle. One of the plurality of electrically-operated actuators is mounted on the front bank which is positioned on a front side in the advancing direction of the vehicle, and two of the plurality of electrically-operated actuators are mounted on the rear bank positioned towards a rear side in the advancing direction of the vehicle.

Also, to achieve the above-mentioned objects, the present invention according to the fourth aspect, in addition to either second or third aspect, is characterized in that the V-type internal combustion engine is configured such that a distance between the cylinder axes of two cylinders of the front bank arranged in parallel in the lateral direction thereof is greater than a distance between the cylinder axes of two cylinders of the rear bank arranged in parallel in the lateral direction thereof.

The front bank includes a substantially rectangular shaped cooling wind guide opening formed in an intermediate portion thereof. The cooling wind guide opening establishes communication between a front portion of the bank and the V-shaped space for directing wind towards the V-shaped space for cooling of the air intake control system, specifically for providing cooling to the electrically-operated actuators thereof. The opening is formed in the lateral direction of the front bank.

Advantages of the Present Invention

According to the present invention as described in the first through fourth aspects, it is possible to arrange the electrically-operated actuators for driving the throttle valves in the V-shaped space defined between the front and rear banks by avoiding the formation of a region into which hot air is liable to easily filled in the V-shaped space, e.g., lower portion of the V-shaped space. Hence, it is possible to reduce the influence of the heat on the electrically-operated actuators (which are situated in upper portion of the V-shaped space) whereby the durability of the electrically-operated actuators can be enhanced. Further, in spite of the fact that the electrically-operated actuators are arranged in the V-shaped space, it is possible to ensure a space for arranging auxiliary equipment or the like in the lower portion of the V-shaped space.

Further, according to the second aspect of the present invention, by mounting the plurality of electrically-operated actuators on the front bank which is easily cooled by a cooling wind, the cooling property of the electrically-operated actuators can be further enhanced.

According to the third aspect of the present invention, by mounting one of the plurality of electrically-operated actuators on the front bank which is positioned on the front side in the advancing direction of the vehicle and by mounting two of the plurality electrically-operated actuators on the rear bank which is positioned on the rear side in the advancing direction of the vehicle, it is possible to perform not only a control of proper intake air quantities for a plurality of respective cylinders but also (in the front bank on which one electrically-operated actuator is arranged) the introduction of a traveling wind to the electrically-operated actuators mounted on the rear bank from a space which is formed on a side where the actuator is not arranged thus effectively cooling the electrically-operated actuators on the rear bank side.

According to the fourth aspect of the present invention, the cooling wind which is generated by the traveling of the vehicle can be positively introduced into the V-shaped space through the cooling wind introducing opening formed in the front bank and the cooling wind can be supplied to the rear bank. Hence, it is possible to effectively cool the electrically-operated actuators which are mounted on the rear bank, thus largely enhancing the cooling property of all electrically-operated actuators which are disposed in the V-shaped space.

For a more complete understanding of the present invention, the reader is referred to the following detailed description section, which should be read in conjunction with the accompanying drawings.

DETAILED DESCRIPTION OF THE ILLUSTRATIVE EMBODIMENTS

Figure 1:
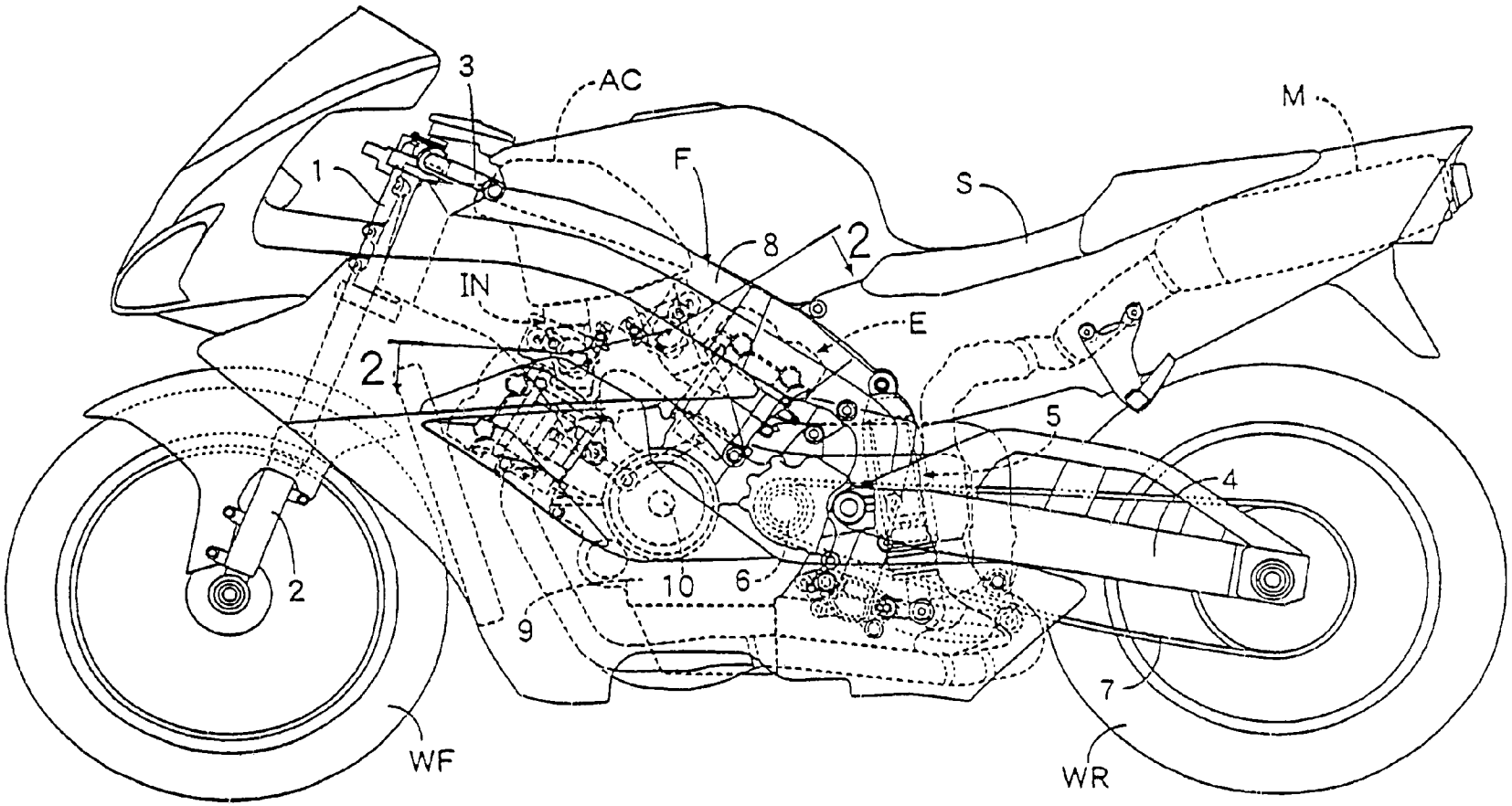
FIG. 1 is a side view of a motorcycle having an intake air control system of a V-type internal combustion engine of the present invention.

A few selected illustrative embodiments of the present invention will now be described in detail, with reference to the accompanying drawings. It should be understood that only structures considered necessary for clarifying the present invention are described herein. Other conventional structures, and those of ancillary and auxiliary components of the system, are assumed to be known and understood by those skilled in the art. Throughout the following detailed description and in the drawings, like numbers refer to like parts.

In the following illustrative embodiments, an intake air control system of the present invention as applied to a V-type internal combustion engine of motorcycles is explained. In the following discussion, a front side of the advancing direction of the motorcycle is set as "front", a rear side of the advancing direction of the motorcycle is set as "rear", a left side of the advancing direction of the motorcycle is set as "left" and a right side of the advancing direction of the motorcycle is set as "right".

Figure 2:
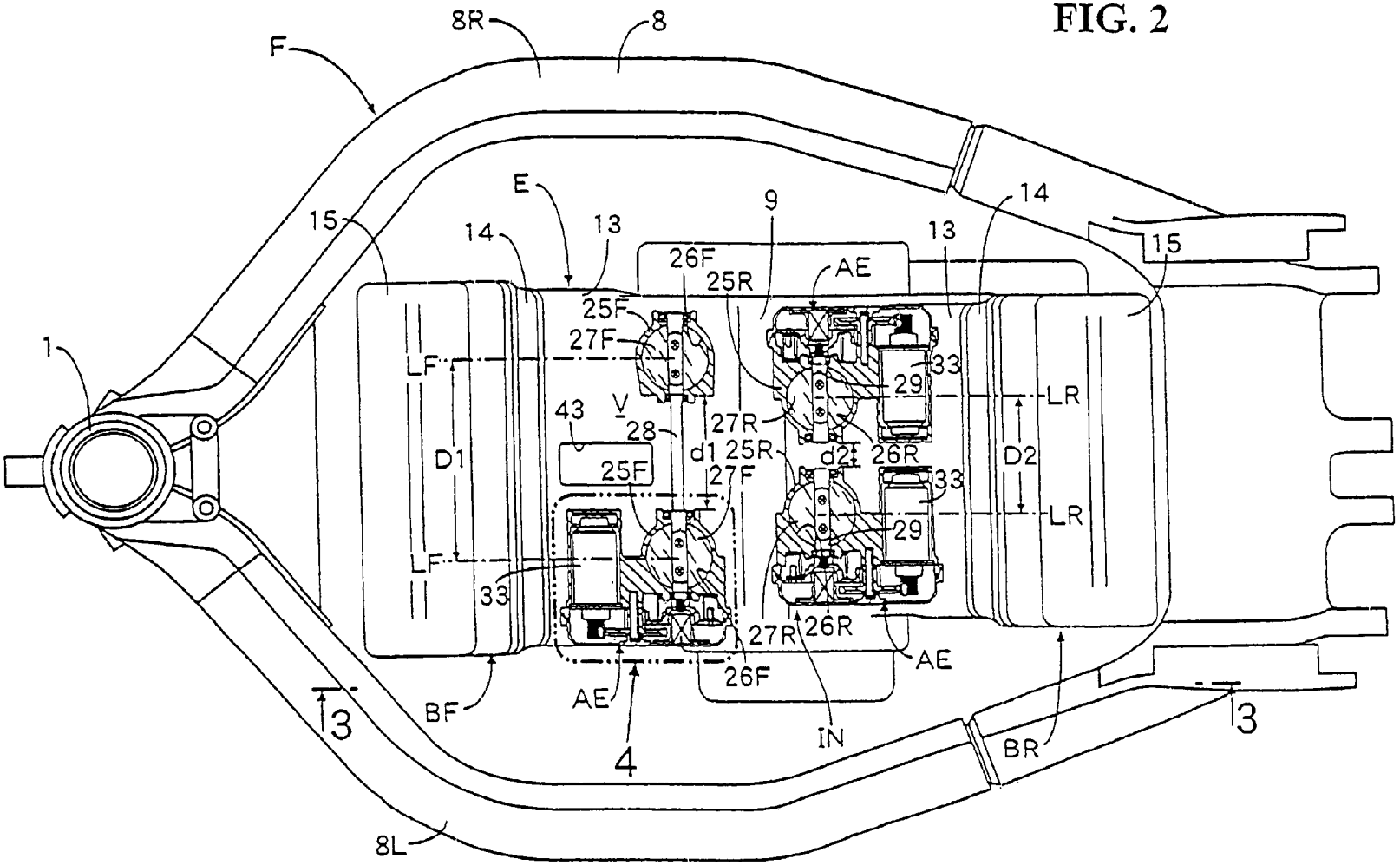
FIG. 2 is a partial enlarged planer cross-sectional view taken along a line 2-2 in FIG. 1 and viewed in the direction of the line arrows.
Figure 3:
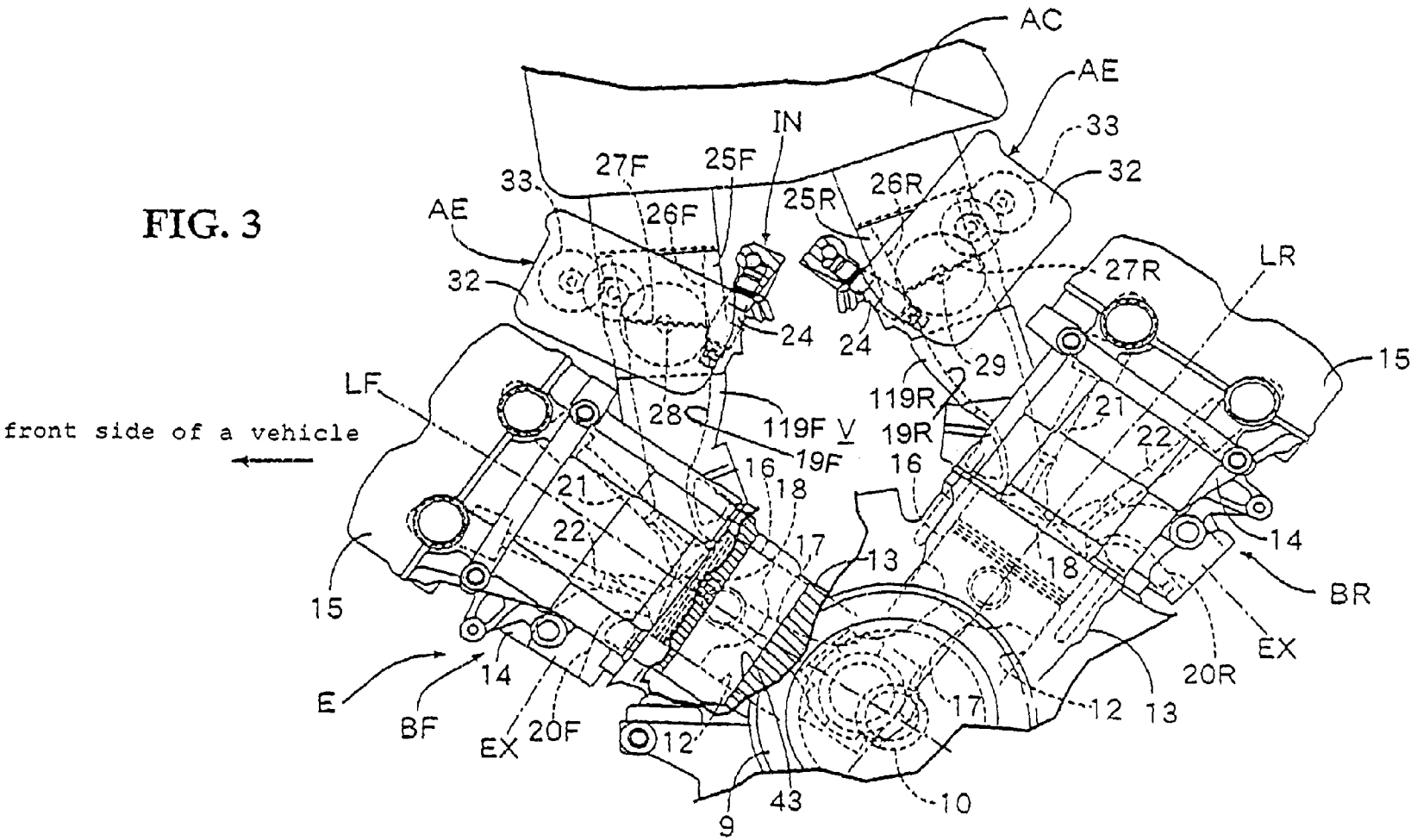
FIG. 3 is a side view taken along a line 3-3 in FIG. 2 and viewed in the direction of the line arrows.
Figure 4:
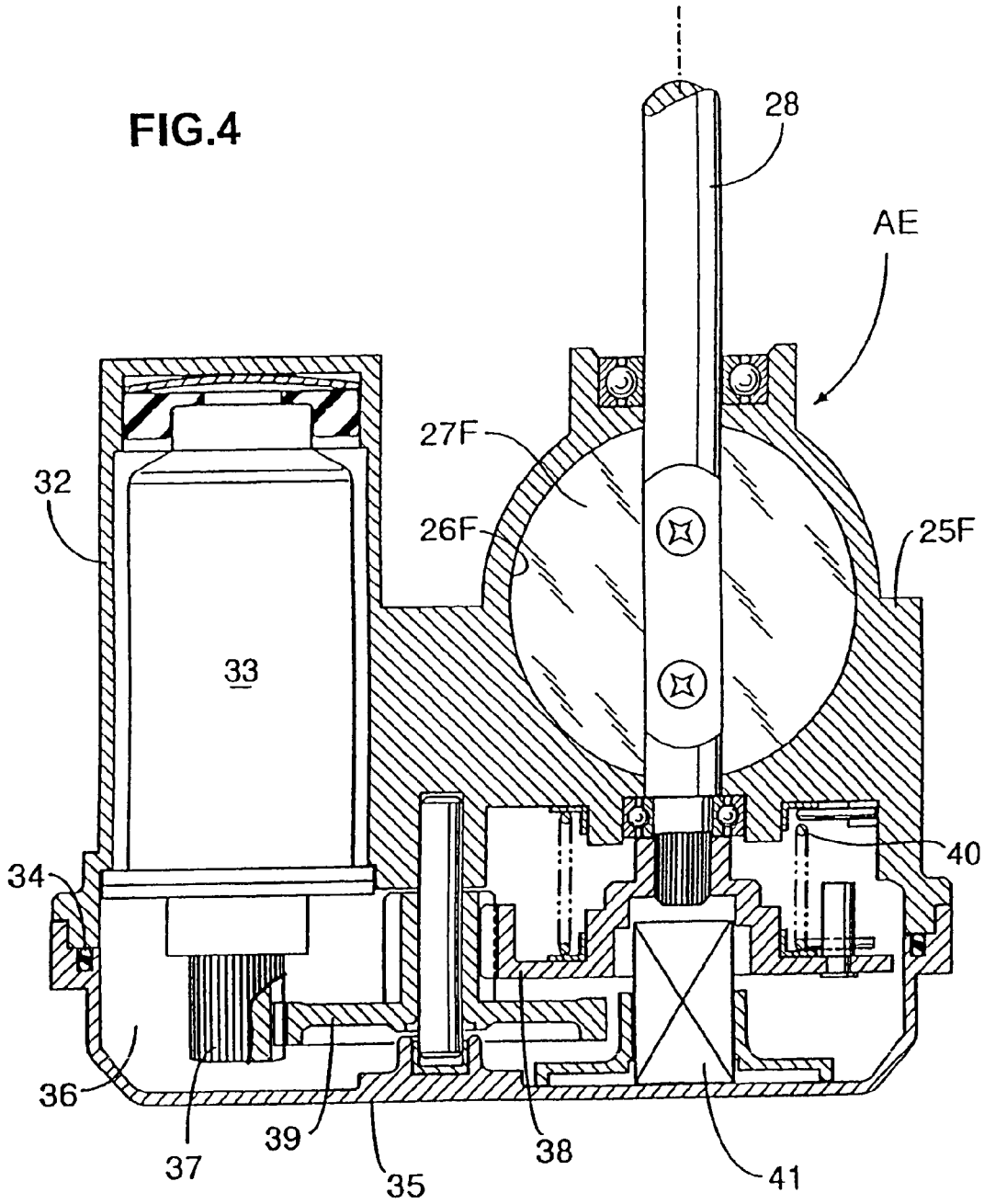
FIG. 4 is an enlarged view of a portion surrounded by dotted lines indicated by 4 shown in FIG. 2.

A first embodiment of the present invention is explained in conjunction with FIG. 1 through FIG. 4, in which FIG. 1 is a side view of a motorcycle which includes an intake air control system of a V-type internal combustion engine according to the present invention; FIG. 2 is a partially enlarged planar cross-sectional view taken along a line 2-2 in FIG. 1; FIG. 3 is a side view taken along a line 3-3 in FIG. 2; and FIG. 4 is an enlarged view of a portion surrounded by dotted line (and indicated by 4) in FIG. 2.

As shown in FIG. 1, a front fork 2 which pivotally supports a front wheel WF is steerably supported on a head pipe 1 mounted on a front end of a vehicle body frame F of the motorcycle, and a steering handle 3 is mounted on an upper portion of the front fork 2. Further, on a rear portion of the vehicle body frame F, a rear fork 4 which pivotally supports a rear wheel WR is supported in a vertically swingable manner. The rear fork 4 is suspended on the vehicle body frame F via a suspension unit 5.

On an intermediate portion of the vehicle body frame F, in the longitudinal direction thereof, a V-type internal combustion engine E is supported by using a conventional mounting unit. An output shaft 6 of the internal combustion engine E is interlockingly connected to the rear wheel WR by way of a chain power transmission mechanism 7 (FIG. 1).

As shown in FIG. 2, a main frame 8 of the vehicle body frame F includes left and right portions 8L, 8R which face left and right side surfaces of the internal combustion engine E, respectively. The portions 8L, 8R are arranged curved outwardly with respect to the engine in the lateral direction in an opposed manner. The V-type internal combustion engine E is stored inside the main frame 8. The intake air control system according to the present invention is provided to the V-type internal combustion engine E. Further, as shown in FIG. 1, a seat S on which a rider sits is arranged above the vehicle body frame F at a rear upper portion of the V-type internal combustion engine E.

As shown in FIG. 1 to FIG. 3, the V-type internal combustion engine E is a four-cylinder OHC-type four-cycle engine, wherein the V-type internal combustion engine E includes a front bank BF which extends upwardly toward a front side of the motorcycle and a rear bank BR which extends upwardly toward a rear side of the motorcycle. Each of the banks BF, BR includes two cylinders which are arranged in parallel in the lateral direction. Lower portions of the front and rear banks BF, BR are integrally connected to each other using a crankcase 9, and a crankshaft 10 which is rotatably supported on the crankcase 9 extends in a direction which is orthogonal to the advancing direction of the motorcycle. The front and rear banks BF, BR form a V-shape cross section when viewed in a side view of the motorcycle. A V-shaped space V is defined between the front and rear banks BF, BR.

As shown in FIGS. 2 and 3, each of the front bank BF and the rear bank BR include a cylinder block 13 having a pair of cylinders 12, 12 arranged in parallel to each other in the lateral direction, a cylinder head 14 joined to a deck surface of the cylinder block 13, and a head cover 15 which integrally covers the cylinder head 14 from above. Pistons 16 which are respectively fitted in the inside of respective two cylinders 12, 12 of the front and rear banks BF, BR in a slidable manner are connected to the crankshaft 10 using connection rods 17.

In the respective cylinder heads 14 of the front and rear banks BF, BR, combustion chambers 18 which face top surfaces of the pistons 16 in an opposed manner corresponding to the respective cylinders 12 are formed, and front and rear intake ports 19F, 19R and front and rear exhaust ports 20F, 20R which communicate with the combustion chambers 18 are formed. These intake and exhaust ports 19F, 19R, 20F and 20R are respectively opened and closed by intake and exhaust valves 21, 22. The intake and exhaust valves 21, 22 are opened and closed at predetermined timing due to an operation of a valve operating mechanism (not shown in the drawing).

It will be understood from FIG. 3 that upper portions of the front and rear intake ports 19F and 19R are integrally formed within respective front and rear runners (ducts) 119F and 119R which extend upwardly from respective cylinder heads 14, 14. The respective runners 119F, 119R extend between the main body of the cylinder head 14, 14 and respective throttle bodies 25F, 25R.

As shown in FIGS. 2 and 3, the V-type internal combustion engine E is configured such that the crankshaft 10 thereof is arranged in a direction (lateral direction) orthogonal to the advancing direction of the motorcycle. The respective cylinder axes LF, LR of the front bank BF and the rear bank BR are arranged to assume a V-shape cross section when viewed in an axial direction of the crankshaft 10. Further, a distance D1 between the cylinder axes LF, LF of two cylinders 12, 12 of the front bank BF which are arranged in parallel in the lateral direction is greater than a distance D2 between the cylinder axes LR, LR of two cylinders 12, 12 of the rear bank BR which are arranged in parallel in the lateral direction.

The front intake ports 19F, 19F which respectively communicate with two cylinders 12, 12 of the front bank BF extend rearwardly from the front bank BF, and have outer ends thereof opened in the V-shaped space V. Further, a plurality of rear intake ports 19R communicate with two cylinders 12 of the rear bank BR. These rear intake ports extend frontwardly from the rear bank BR, and have respective outer ends thereof opened in the V-shaped space V. The intake ports 19F, 19F, 19R, 19R are a part of the intake air control system.

The plurality of front exhaust ports 20F which communicate with two cylinders 12, 12 of the front bank BF extend frontwardly from the front bank BF, and have outer ends thereof opened frontwardly from the front bank BF and communicate with an exhaust system EX. Further, the plurality of rear exhaust ports 20R, which communicate with two cylinders 12, 12 of the rear bank BR, extend rearwardly from the rear bank BR, and each have a respective outer end thereof opened rearwardly from the rear bank BR and in communication with the exhaust system EX. The exhaust system EX extends rearwardly from the internal combustion engine E. A silencer M is connected to a downstream end of the exhaust system EX (FIG. 1).

As shown in FIGS. 1 and 3, the intake system IN of the V-type internal combustion engine E includes an air cleaner AC which is arranged on an upper portion of the V-shaped space V of the engine E, a pair of respective front and rear throttle bodies 25F, 25R which are respectively connected to a discharge port formed in a lower portion of the air cleaner AC, and front and rear intake ports 19F, 19R which are respectively connected to the throttle bodies 25F, 25R.

As shown in FIG. 2 and FIG. 3, both of respective pairs of left and right front throttle bodies 25F, 25F are arranged inside of the V-shaped space V. These throttle bodies 25F, 25F are arranged close to a rear surface side of the front bank BF and, at the same time, are arranged in parallel in the lateral direction with a distance d1 therebetween.

On the other hand, left and right rear throttle bodies 25R, 25R are arranged close to the front surface side of the rear bank BR and, at the same time, are arranged in parallel in the lateral direction with a distance d2 which is narrower than the distance d1. Further, as shown in FIG. 2, inner half portions of the left and right rear throttle bodies 25R, 25R which are arranged close to each other and the left and right front throttle bodies 25F, 25F do not overlap each other when viewed in the longitudinal direction. In other words, the inner half portions of the left and right rear throttle bodies 25R, 25R which are arranged close to each other are released frontwardly without being obstructed by the left and right front throttle bodies 25F, 25F.

Upstream sides of front and rear intake passages 26F, 26R which are formed in the inside of the pair of left and right front throttle bodies 25F, 25F and the pair of left and right rear throttle bodies 25R, 25R respectively communicate with discharge ports formed in the lower portion of the air cleaner AC. The downstream sides of the front and rear intake passages 26F, 26R respectively communicate with upstream ends of the front and rear intake ports 19F, 19R. Butterfly-type front and rear throttle valves 27F, 27R are arranged in the front and rear intake passages 26F, 26R formed inside of the front and rear throttle bodies 25F, 25R such that the front and rear throttle valves 27F, 27R can be opened and closed between a fully-open position and a fully-closed position.

As shown in FIG. 3, on outer (wall) surfaces of the respective left and right front throttle bodies 25F, 25F and the respective left and right rear throttle bodies 25R, 25R which are arranged to face each other in an opposed manner, fuel injection valves 24 are respectively mounted, and fuel injection nozzles of the fuel injection valves 24 are respectively directed toward insides of the left and right front intake ports 19F and the left and right rear intake ports 19R.

As shown in FIG. 2, the pair of left and right front throttle valves 27F, 27F on the front bank BF side are connected with each other using a common front valve shaft 28. On the other hand, the pair of left and right rear throttle valves 27R, 27R of the rear bank BR side are separately connected to respective rear valve shafts 29, 29.

The front valve shaft 28 which is commonly connected to the pair of left and right front throttle valves 27F, 27F extends in a lateral direction between the front throttle bodies 25F, 25F, and both ends of the front valve shaft 28 are rotatably supported on the respective throttle bodies 25F, 25F. On the other hand, the rear valve shafts 29, 29 are respectively rotatably supported on the pair of left and right rear throttle bodies 25R, 25R in a laterally coaxial manner.

The respective front throttle valves 27F, 27F of the left and right front throttle bodies 25F, 25F are commonly driven by one electrically-operated actuator AE, while the respective rear throttle valves 27R, 27R of the left and right rear throttle bodies 25R, 25R are respectively independently driven by two electrically-operated actuators AE, AE. As shown in FIGS. 2 and 3, one electrically-operated actuator AE, is associate with one (left) front throttle body 25F, which drives both of the left and right front throttle valves 27F, 27F. The electrically-operated actuator AE is arranged between the front throttle body 25F and one cylinder head 14 mounted on the front bank BF.

Further, to the left and right rear throttle bodies 25R, 25R, two electrically-operated actuators AE, AE which independently drive the left and right rear throttle valves 27R, 27R are respectively provided, and the electrically-operated actuators AE, AE are respectively arranged between the rear throttle bodies 25R, 25R and the left and right cylinder heads 14, 14 of the rear banks BR, BR.

Further, as shown in FIG. 3, although the plurality of electrically-operated actuators AE, AE are disposed inside of the V-shaped space V, a storing space having a relatively large volume can be ensured below the actuators AE, AE. Hence, it is possible to store and arrange the auxiliary equipments of the internal combustion engine E in the storing space, e.g., lower portion of the V-shaped space V. Further, due to the above-mentioned arrangement of the plurality of electrically-operated actuators AE, it is possible to prevent the electrically-operated actuators AE from being overheated by hot air from the engine which easily filled into the inside of the V-shaped space V.

Although the above-mentioned three electrically-operated actuators AE differ in their relative arrangement with respect to the front and rear throttle bodies 25F, 25R, all electrically-operated actuators have the same structure. Therefore, a structure of the electrically-operated actuator AE on the front bank BF side which drives the left and right front throttle valves 27F, 27F in common. The structure of the electrically-operated actuator is specifically explained with reference to FIG. 4 hereinafter.

As shown in FIG. 4, the electrically operator operated actuator AE includes a housing 32, and a drive motor 33 housed and supported in the housing 32. The housing 32 is integrally formed with one (left) front throttle body 25F. Further, a cover body 35 is fixed to an outer end wall of the one front throttle body 25F with a sealing material 34 sandwiched therebetween. A power transmission chamber 36 is formed inside the cover body 35.

In the power transmission chamber 36, a pinion 37 which is fixed to an output end of the drive motor 33 is arranged. An outer end of the front valve shaft 28 which serves in common for the left and right front throttle valves 27F, 27F faces the inside of the power transmission chamber 36, and a sector gear 38 is engaged with the outer end of the front valve shaft 28 by spline fitting. The sector gear 38 is interlockingly connected with a pinion 37 of the drive motor 33 by way of an idle gear 39 which is rotatably supported between the front throttle body 25F and the cover body 35.

Due to the operation of the drive motor 33, the front valve shaft 28 is driven with deceleration, and the left and right front throttle valves 27F, 27F which are fixed to the front valve shaft 28 are simultaneously driven to be opened or closed from a full open position to a fully closed position. Inside of the power transmission chamber 26, a return spring 40 which serves for returning the left and right front throttle valves 27F, 27F to the fully closed position. The return spring 40 is made of a torsion spring arranged between an inner end wall of the front throttle body 25F and the sector gear 38. A rotational angle sensor 41 is arranged to face an end surface of the front valve shaft 28 in an opposed manner and an opening of the front throttle valves 27F, 27F is detected by the rotational angle sensor 41.

When a rider (operator) of a motorcycle manipulates a manipulation portion of a throttle grip or the like, the drive motor 33 of the electrically-operated actuator AE is rotated in response to a manipulation quantity, and this rotation is transmitted to the front valve shaft 28 by way of the pinion 37, the idle gear 39 and the sector gear 38. Hence, the front valve shaft 28 is rotated with deceleration whereby the left and right front throttle valves 27F, 27F can be simultaneously opened against a closing force of the return spring 40. Here, the drive motor 33 of the electrically-operated actuator AE which is mounted on one front throttle body 25F is arranged in front portion of the front throttle body 25F.

As shown in FIGS. 2 and 3, on the left and right rear throttle bodies 25R, 25R which are respectively provided with the rear throttle valves 27R, 27R, electrically-operated actuators AE, AE are respectively mounted. The respective throttle valves 27R are independently driven by the respective electrically-operated actuators AE, AE, and the respective drive motors 33, 33 of these electrically-operated actuators AE, AE are arranged behind the left and right rear throttle bodies 25R, 25R.

As described above, the left and right front throttle valves 27F, 27F, one (left) rear throttle valve 27R and another (right) rear throttle valve 27R are respectively subjected to drive controls by three electrically-operated actuators AE. Therefore, by selectively performing valve opening controls of the left and right front throttle valves 27F, 27F, one rear throttle valve 27R and another rear throttle valve 27R, it is possible to perform controls of proper intake quantities for both the cylinders of the front bank BF, one cylinder of the rear bank BR and another cylinder of the rear bank BR thus enabling proper operation controls of operations of the engine E such as a low-load operation, an intermediate operation, a high-load operation, etc.

As shown in FIGS. 2 and 3, a wind guide opening 43 having a rectangular cross-sectional shape is provided at an intermediate portion of the front bank BF in the left-and-right direction of a portion close to the crankcase 9. That is, the wind guide opening is formed between the left and right cylinder blocks 13, 13 which are laterally arranged in parallel. A front face of the wind guide opening 43 is formed frontwardly toward a front side of the front bank BF, while a rear face of the wind guide opening 43 is formed toward the V-shaped space V. A traveling, entering wind which is generated by traveling of the motorcycle is introduced to the V-shaped space V through the wind guide opening 43 which facilitates effective cooling of the front and rear throttle bodies 25F, 25R, the electrically-operated actuators AE and the like of the intake system IN arranged inside of the V-shaped space V.

Next, the manner of operation of the first embodiment is explained.

First of all, when the rider manipulates a manipulating portion of the throttle grip or the like, the drive motors 33 of the respective electrically-operated actuators AE are rotated corresponding to a manipulation quantity of the manipulating portion and perform the drive controls of the front and rear throttle valves 27F, 27R.

Accordingly, the respective drive motors 33 of the electrically-operated actuators AE are selectively driven to individually drive the left and right front throttle valves 27F, 27F, one (left) rear throttle valve 27R and another (right) rear throttle valve 27R and hence, proper intake quantities of the front cylinder and the rear left and right cylinders can be controlled. More significantly, even when one or two electrically-operated actuators AE suffer from a breakdown due to a certain cause, it is possible to continue the running of the engine E by another functional electrically-operated actuators AE.

Here, the plurality of electrically-operated actuators AE which are arranged in the V-shaped space V between the front and rear banks BF, BR are respectively arranged in the space defined by the cylinder heads 14 of the front and rear banks BF, BR and the front and rear, throttle bodies 25F, 25R. Accordingly, it is possible to ensure the housing space for arranging the auxiliary equipment inside of the V-shaped space V, e.g., lower portion of the V-shaped space. More significantly, the electrically-operated actuators AE can be spaced apart from a space in which the hot air is easily filled. Therefore, overheating of the electrically-operated actuator AE can be avoided to increase their durability against the heat.

Further, in the first embodiment, since the electrically-operated actuator AE is arranged in only one of left and right front throttle bodies 25F, 25F which are mounted on the front bank BF, it is possible to easily introduce the traveling wind to the electrically-operated actuator AE on the rear bank BR side from the space on a side where the electrically-operated actuator AE is not arranged whereby the cooling property of two electrically-operated actuators AE, AE arranged in the rear bank BR can be increased. Further, the traveling wind is introduced into the V-shaped space V through the wind guide opening 43 formed in the front bank BF thus effectively cooling the electrically-operated actuators AE disposed in the V-shaped space V.

Figure 5:
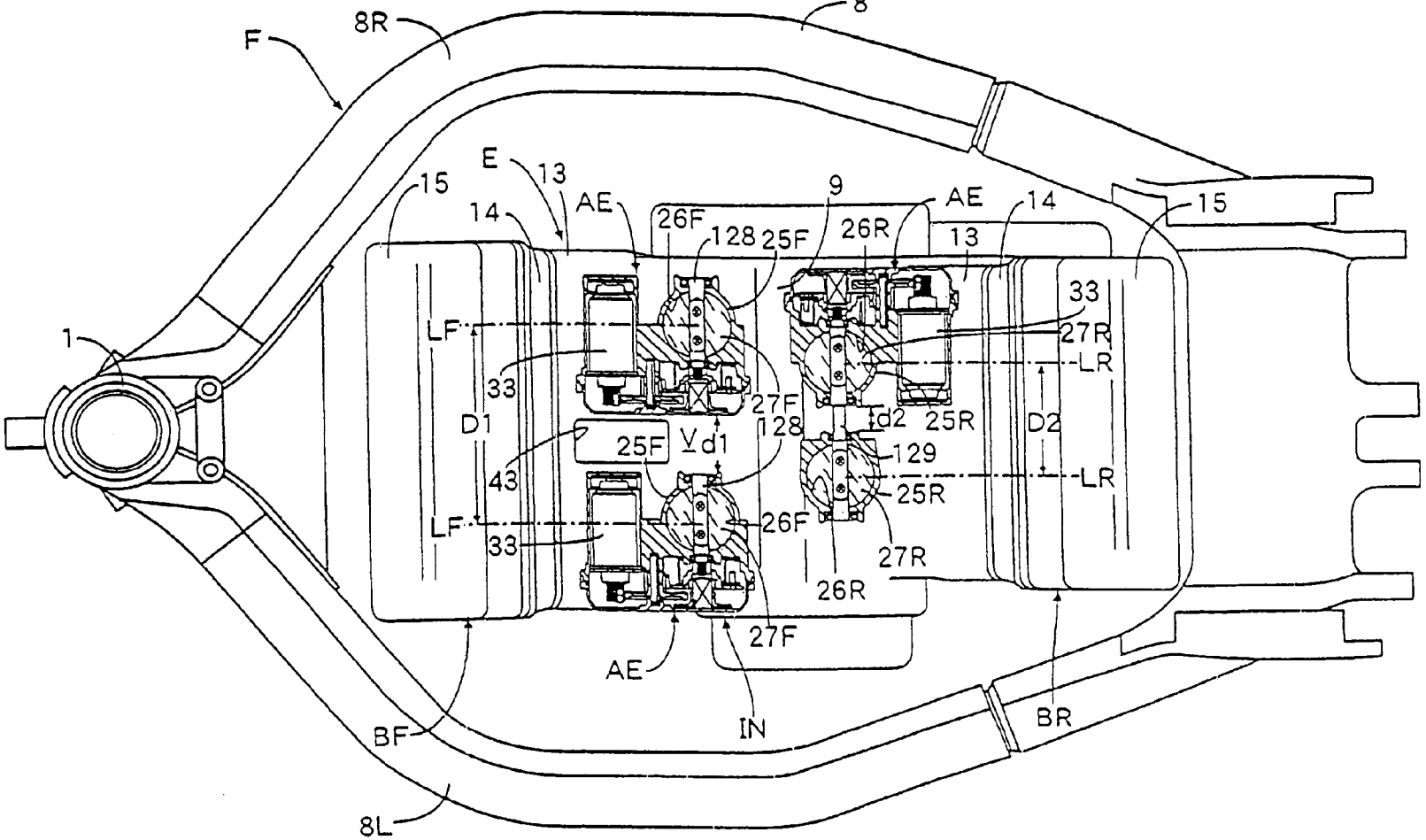
FIG. 5 is a view showing a second embodiment corresponding to FIG. 2.

Next, the second embodiment of the present invention is explained in conjunction with FIG. 5.

FIG. 5 is a view corresponding to FIG. 2 in the above-mentioned first embodiment and parts identical with the parts of the first embodiment are given same symbols.

In the second embodiment, left and right front throttle valves 27F, 27F are driven by respective electrically-operated actuators AE, AE and, at the same time, the left and right rear throttle valves 27R, 27R are driven by a common electrically-operated actuator AE. On a back surface side of the front bank BF, the left and right front throttle bodies 25F, 25F which are arranged in parallel in the lateral direction are respectively provided with the front valve shafts 128, 128 which are fixed to the front throttle valves 27F, 27F mounted thereon. These front valve shafts 128, 128 are arranged coaxially in the lateral direction.

The electrically-operated actuators AE, AE are respectively mounted on the left and right front throttle bodies 25F, 25F, and the left and right front throttle valves 27F, 27F are individually driven by the electrically-operated actuators AE, AE. Further, on the front surface side of the rear bank BR, the left and right rear throttle bodies 25R, 25R which are laterally arranged in parallel are provided with one common rear valve shaft 129 which is fixed to the rear throttle valves 27R, 27R mounted thereon, and the rear valve shaft 129 extends in the lateral direction. The electrically-operated actuator AE is mounted on one (right) of the left and right rear throttle bodies 25R, 25R, and both of the left and right rear throttle valves 27R, 27R are driven by the common electrically-operated actuator AE.

In the same manner as the first embodiment, a wind guide opening 43 for a cooling wind is formed in the front bank BF between left and right cylinder blocks 13, 13 and the wind guide opening 43 is opened in a longitudinal surface of the front bank BF between the left and right front throttle bodies 25F, 25F and traveling wind is guided into a V-shaped space V through a space defined between the left and right front throttle bodies 25F, 25F. Further, in the same manner as the first embodiment, a distance D1 between cylinder axes LF, LF of left and right cylinder blocks 13, 13 of the front bank BF is set larger than a distance D2 between cylinder axes LR, LR of the left and right cylinder blocks 13, 13 of the rear bank BR.

According to the second embodiment, with the provision of the plurality of electrically-operated actuators AE on the front bank BF which can positively introduce the traveling wind, the cooling property of these actuators AE can be enhanced.

Here, in the first and second embodiments, since the distance D2 between the cylinder axes LR, LR of the left and right cylinders 12, 12 mounted on the rear bank BR is set smaller than the distance D1 between the cylinder axes LF, LF of the left and right cylinders 12, 12 mounted on the front bank BF, a vehicle width at a riding position of the rider on which the rider sits on a seat S behind the internal combustion engine E is set smaller than the vehicle width in front of the riding position. Accordingly, the comfortableness of the rider can be enhanced.

Although only few illustrative embodiments of the present invention have been explained herein, the present invention is not limited to such embodiments, and various several embodiments are possible within a scope of the present invention.

For example, in the above-mentioned embodiments, the explanation is made with respect to a case in which the intake system structure according to the present invention is applied to the V-type internal combustion engine of the motorcycle. However, it is needless to say that the intake system structure according to the present invention is applicable to other V-type internal combustion engines of other vehicles.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. An intake air control system for a V-type internal combustion engine of the type having a crankshaft;

front and rear banks exhibiting a V-shaped section when viewed in an axial direction of the crankshaft, said V-shaped section defining a V-shaped space therein; and a plurality of cylinders formed on each of the front and rear banks; each of said cylinders having a cylinder head; front and rear intake ports formed in the respective front and rear cylinder heads; wherein said intake air control system is disposed in the V-shaped space;

said intake system comprising front and rear throttle bodies respectively having front and rear throttle valves mounted thereon; and a plurality of electrically-operated actuators; each of said electrically-operated actuators driving at least one of the throttle valves; wherein the electrically-operated actuators comprise electric motors which are respectively situated in an upper portion of the V-shaped space between the cylinder heads of the front and rear banks, the electric motors comprising at least one front electric motor operatively associated with the front bank and at least one rear electric motor operatively associated with the rear bank, and wherein the throttle bodies are situated between the front and rear electric motors.

2. An intake air control system of a V-type internal combustion engine according to claim 1, wherein the V-type internal combustion engine is a 4-cylinder engine having two cylinders on each of the front and rear banks respectively, and in a state that the V-type internal combustion engine is mounted on a vehicle, the crankshaft of the V-type internal combustion engine is arranged orthogonal to an advancing direction of the vehicle, and the plurality of electrically-operated actuators are mounted on the front bank of said engine.

3. An intake air control system of a V-type internal combustion engine according to claim 1, wherein the V-type internal combustion engine is a 4-cylinder engine having two cylinders on each of the front and rear banks respectively, and in a state that the V-type internal combustion engine is mounted on a vehicle, the crankshaft of the engine is arranged orthogonal to the advancing direction of the vehicle, and one of the plurality of electrically-operated actuators is mounted on the front bank positioned on a front side in the advancing direction of the vehicle, and two of the plurality of electrically-operated actuators are mounted on the rear bank of said engine.

4. An intake air control system of a V-type internal combustion engine according to claim 2, wherein the V-type internal combustion engine is configured such that a distance between the cylinder axes of two cylinders which are arranged in parallel in the lateral direction on the front bank positioned towards the front side in the advancing direction of the vehicle is set larger than a distance between the cylinder axes of two cylinders arranged in parallel in the lateral direction of the rear bank of said engine;

and wherein the front bank has a cooling wind guide opening formed in an intermediate portion thereof between the two cylinders of the front bank which are arranged in parallel; and wherein said opening communicates between the front portion of the front bank and the V-shaped space, to allow a cooling wind to flow between the two cylinders of the front bank and into the V-shaped space during forward movement of the vehicle.

5. An intake air control system of a V-type internal combustion engine according to claim 3, wherein the V-type internal combustion engine is configured such that a distance between the cylinder axes of two cylinders which are arranged in parallel in the lateral direction on the front bank positioned towards the front side in the advancing direction of the vehicle is set larger than a distance between the cylinder axes of two cylinders arranged in parallel in the lateral direction of the rear bank of said engine;

and wherein the front bank has a cooling wind guide opening formed in an intermediate portion thereof between the two cylinders of the front bank which are arranged in parallel; and wherein said opening communicates between the front portion of the front bank and the V-shaped space, to allow a cooling wind to flow between the two cylinders of the front bank and into the V-shaped space during forward movement of the vehicle.

6. A V-type internal combustion engine for a vehicle, said engine comprising:

a crankcase;

a crankshaft rotatably supported in the crankcase;

a front bank extending upwardly towards a front side of the vehicle, the front bank including two cylinders which are arranged in parallel, and having a cooling wind guide opening formed in an intermediate portion thereof between the two cylinders of the front bank which are arranged in parallel;

a rear bank extending upwardly towards a rear side of the vehicle;

said front bank and said rear bank connected to each other at lower portions thereof using the crankcase and defining a V-shaped space therebetween when viewed in a side view; said V-shaped space having a upper portion and a lower portion; and an intake air control system disposed in the upper portion of the V-shaped space;

said intake air control system comprising front and rear throttle bodies respectively having front and rear throttle valves mounted thereon; and a plurality of electrically-operated actuators; each of said electrically-operated actuators drive at least one of the throttle valves; wherein the electrically-operated actuators comprise electric motors which are respectively situated in the upper portion of the V-shaped space, the electric motors comprising at least one front electric motor operatively associated with the front bank and at least one rear electric motor operatively associated with the rear bank, and wherein the throttle bodies are situated between the front and rear electric motors;

and wherein said opening of the front bank communicates between the front portion of the front bank and the V-shaped space, to allow a cooling wind to flow between the two cylinders of the front bank and into the V-shaped space during forward movement of the vehicle.

7. A V-type internal combustion engine according to claim 6, wherein said intake air control system front and rear runners extend from each of the respective throttle bodies to respective cylinder heads of the front and rear banks.

8. A V-type internal combustion engine according to claim 6, wherein each of the front and rear banks includes a plurality of cylinders formed thereon; each of said cylinders having a respective cylinder head; and the electrically-operated actuators are respectively arranged between said cylinder heads of the front and rear banks.

9. A V-type internal combustion engine according to claim 6, wherein the V-type internal combustion engine is a 4-cylinder engine having two cylinders on each of the front and rear banks respectively;

the crankshaft is arranged orthogonal to the advancing direction of the vehicle; and wherein one of the plurality of electrically-operated actuators is mounted on the front bank and two of the plurality of electrically-operated actuators are mounted on the rear bank.

10. A V-type internal combustion engine according to claim 6, wherein the V-type internal combustion engine is a 4-cylinder engine having two cylinders on each of the front and rear banks respectively;

the crankshaft is arranged orthogonal to the advancing direction of the vehicle; and wherein two of the plurality of electrically-operated actuators is mounted on the front bank and one of the plurality of electrically-operated actuators are mounted on the rear bank.

11. A V-type internal combustion engine according to claim 6, wherein the cooling wind guide opening is configured to direct a flow of wind towards the electrically-operated actuators during operation of the vehicle.

12. A V-type internal combustion engine according to claim 11, wherein said opening has a substantially rectangular shape.

13. An internal combustion engine comprising a crankcase;

a crankshaft operatively disposed in the crankcase;

a front bank and a rear bank;

each of said front bank and said rear bank include a cylinder block having a plurality of cylinders and cylinder heads joined to the cylinder block; each of said cylinder head giving intake port;

said front bank and said rear bank connected to each other at lower portions thereof using the crankcase and defining a V-shaped space therebetween; said V-shaped space having a upper portion and a lower portion;

an intake air control system comprising front and rear throttle bodies associated with respective said front and rear banks; said front and rear throttle bodies having front and rear throttle valves, and a plurality of electrically-operated actuators, wherein each of the plurality of electrically-operated actuators drive at least one of said throttle valves;

wherein said electrically-operated actuators comprise electric motors which are respectively disposed in an upper portion of the V-shaped space between the cylinder heads of said front bank and said rear bank, the electric motors comprising at least one front electric motor operatively associated with the front bank and at least one rear electric motor operatively associated with the rear bank, and wherein the throttle bodies are situated between the front and rear electric motors.

14. An internal combustion engine according to claim 13, wherein said lower portion of the V-shaped space is configured to receive engine auxiliary equipment.

15. An internal combustion engine according to claim 13, wherein said internal combustion engine is a V-type 4-cylinder internal combustion engine having two cylinders on each of the front and rear banks respectively, and wherein one of the plurality of electrically-operated actuators is mounted on the front bank and two of the plurality of electrically-operated actuators are mounted on the rear bank.

16. An internal combustion engine according to claim 13, wherein said internal combustion engine is a V-type 4-cylinder internal combustion engine having two cylinders on each of the front and rear banks respectively, and wherein two of the plurality of electrically-operated actuators are mounted on the front bank and one of the plurality of electrically-operated actuators is mounted on the rear bank.

17. An internal combustion engine according to claim 13, wherein said internal combustion engine is a 4-cylinder engine having two cylinders on the front and rear banks respectively, and the crankshaft of the engine is arranged orthogonal to the advancing direction of the vehicle.

18. An internal combustion engine according to claim 13, wherein said internal combustion engine is a 4-cylinder V-type internal combustion engine having two cylinders on each of the front and rear banks respectively, wherein said V-type internal combustion engine is configured such that a distance between cylinder axes of two cylinders of the front bank is greater than a distance between the cylinder axes of two cylinders of the rear bank.

19. An internal combustion engine according to claim 13, wherein said front bank includes a cooling wind guide opening formed therein in a middle portion thereof, and wherein said wind guide opening is configured to direct flow of wind towards the electrically-operated actuators disposed in the V-shaped space during operation of the vehicle.

20. An internal combustion engine according to claim 13, wherein the distance between left and right throttle bodies of said front bank is greater than a distance between left and right throttle bodies of said rear bank.

* * * * *